US010000351B2

(12) United States Patent
Fischer et al.

(10) Patent No.: US 10,000,351 B2
(45) Date of Patent: Jun. 19, 2018

(54) SPLICER DEVICE

(71) Applicant: BHS Corrugated Maschinen-und Anlagenbau GmbH, Weiherhammer (DE)

(72) Inventors: Markus Fischer, Mantel (DE); Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 565 days.

(21) Appl. No.: 14/683,607

(22) Filed: Apr. 10, 2015

(65) Prior Publication Data

US 2015/0291380 A1 Oct. 15, 2015

(30) Foreign Application Priority Data

Apr. 11, 2014 (DE) ..... 10 2014 207 050

(51) Int. Cl.
*B65H 19/18* (2006.01)
*B65H 23/038* (2006.01)

(52) U.S. Cl.
CPC ..... *B65H 19/1805* (2013.01); *B65H 19/1852* (2013.01); *B65H 23/038* (2013.01); *B65H 2701/1762* (2013.01)

(58) Field of Classification Search
CPC ..... B65H 19/1805; B65H 19/1852; B65H 23/038; B65H 2701/1762
See application file for complete search history.

(56) References Cited

U.S. PATENT DOCUMENTS 3,252,671 A * 5/1966 Malcolm, Jr. ..... A24C 5/20 242/553
3,841,944 A * 10/1974 Harris, Jr. ..... B65H 19/1852 156/159
3,858,819 A * 1/1975 Butler, Jr. ..... B65H 19/1852 242/552

(Continued)

FOREIGN PATENT DOCUMENTS

DE 14 99 136 A1 1/1970
DE 23 30 945 A1 1/1975

(Continued)

*Primary Examiner* — Michael E Gallion
(74) *Attorney, Agent, or Firm* — McGlew and Tuttle, P.C.

(57) ABSTRACT

The invention relates to a splicer device comprising a first unwinding device to unwind a non-endless first material web and a second unwinding device to unwind a non-endless second material web as well as a joining device for joining together the non-endless material webs to form an endless material web. The splicer device further has a storage carriage, which comprises at least one deflection roller to deflect the endless material web and is displaceable between two end positions to form or loosen material web loops of the endless material web. The at least one deflection roller has a respective central longitudinal axis and is tiltable between two tilt end positions to influence a running direction of the endless material web. The splicer device further has an information processing unit to cause tilting of the at least one deflection roller depending on positional information regarding the endless material web and/or another endless material web to be joined thereto.

21 Claims, 14 Drawing Sheets

(56) References Cited

U.S. PATENT DOCUMENTS 3,989,576 A * 11/1976 Collin ..... B65H 19/10 156/361
4,065,067 A * 12/1977 Martinez ..... B65H 19/14 242/421.6
4,170,506 A * 10/1979 Marschke ..... B65H 19/1852 156/159
4,519,858 A * 5/1985 Martin ..... B65H 19/1852 156/104
5,171,396 A * 12/1992 Rank ..... B65H 19/1852 156/157
5,624,526 A * 4/1997 Perecman ..... B65B 51/067 156/159
5,730,389 A * 3/1998 Biagiotti ..... B65H 19/1852 156/502
6,027,591 A * 2/2000 O'Dwyer ..... B65H 19/14 156/157
6,451,145 B1 * 9/2002 Forbes ..... B65H 19/1836 156/157
6,786,264 B1 * 9/2004 Torres Martinez ..... B65H 19/1852 156/157
6,814,123 B2 * 11/2004 Erickson ..... B65H 19/102 156/157
6,820,836 B2 * 11/2004 Sato ..... B65H 19/1852 156/504
6,860,309 B2 * 3/2005 Hartman ..... B26D 1/405 156/505
6,966,961 B2 * 11/2005 Adami ..... B65H 19/1836 156/157
7,441,579 B2 * 10/2008 Adami ..... B65H 19/1852 156/159
9,108,382 B2 * 8/2015 Gnan ..... B31F 1/20
2002/0074087 A1 * 6/2002 Hashimoto ..... B65H 19/1868 156/362
2003/0080235 A1 * 5/2003 Sato ..... B65H 19/1852 242/554.2
2004/0084133 A1 * 5/2004 Adami ..... B65H 19/1836 156/159
2004/0084561 A1 * 5/2004 Clifford ..... B65H 19/14 242/552
2005/0061846 A1 * 3/2005 Seaberg ..... B65H 19/14 226/118.3
2005/0279461 A1 * 12/2005 Adami ..... B65H 19/1852 156/502
2007/0075179 A1 * 4/2007 Mizutani ..... B65H 19/14 242/555.4
2008/0135158 A1 * 6/2008 Baumli ..... B65H 19/1805 156/157
2014/0345804 A1 * 11/2014 Fischer ..... B32B 37/1036 156/378
2017/0088380 A1 * 3/2017 Mark ..... B65H 19/14
2017/0275116 A1 * 9/2017 Gnan ..... B65H 19/102
2017/0297849 A1 * 10/2017 Gnan ..... B65H 16/021

FOREIGN PATENT DOCUMENTS

DE 10 2004 018600 A1 11/2005
DE 10 2005 032 599 B3 10/2006
EP 0 453 727 A2 10/1991

* cited by examiner

SPLICER DEVICE

CROSS-REFERENCE TO RELATED APPLICATIONS

This application claims the priority of German Patent Application, Serial No. 10 2014 207 050.3, filed on 11 Apr. 2014, pursuant to 35 U.S.C. 119(a)-(d), the content of which is incorporated herein by reference in its entirety as if fully set forth herein.

FIELD OF THE INVENTION

The invention relates to a splicer device for splicing material webs, in particular paper webs for producing a corrugated cardboard web in a corrugated cardboard installation. The invention further relates to a corrugated cardboard installation for producing corrugated cardboard webs comprising at least one splicer device of this type.

BACKGROUND OF THE INVENTION

Known splicer devices join a running out non-endless first material web to a new non-endless second material web such that a virtually endless material web is obtained. This process is referred to as splicing in technical language while a corresponding device is referred to as splicer device. When producing corrugated cardboard webs, the endless material webs are usually joined to each other in the manner of layers. In this process, a lateral offset occurs frequently between these endless material webs, which may require further processing of the corrugated cardboard web. In general, said further processing increases the costs involved in the production of the corrugated cardboard web.

SUMMARY OF THE INVENTION

The invention is based on the object of providing a splicer device that allows endless material webs joined to each other in the manner of layers to be produced in an extremely economical and precise manner. Another object is to provide a splicer device that ensures a defined, in other words precise, guidance of the endless material web. Another object is to provide a corrugated cardboard installation comprising at least one splicer device of this type.

This object is achieved according to the invention by a splicer device for splicing material webs, comprising a first unwinding device to unwind a non-endless first material web from a first material roll, a second unwinding device to unwind a non-endless second material web from a second material roll, a joining device for joining together the non-endless first material web and the non-endless second material web to form an endless material web, a storage carriage which comprises at least one deflection roller to deflect the endless material web, and is displaceable along a displacement path between a first end position and a second end position to form or loosen material web loops of the endless material web, wherein the at least one deflection roller has a respective central longitudinal axis, and is tiltable between a first tilt end position and a second tilt end position by tilting the respective central longitudinal axis to influence a running direction of the endless material web, and an information processing unit to cause tilting of the at least one deflection roller depending on positional information regarding the endless material web and/or another endless material web to be joined to the endless material web, and by a corrugated cardboard installation for producing corrugated cardboard webs, comprising at least one splicer device according to the invention, a first sensor assembly that is in signal connection with the information processing unit to detect the position of the endless material web, and a second sensor assembly that is in signal connection with the information processing unit to detect the position of another endless material web, wherein preferably the first and second sensor assembly are in each case arranged upstream of a corrugated cardboard production assembly to produce a corrugated cardboard web. The gist of the invention is that the storage carriage has at least one tiltable, in other words deflectable, deflection roller around which the endless material web runs. The running direction of the endless material web in the splicer device is thus influencable, in other words changeable, by means of the at least one deflection roller.

A congruent arrangement of the endless material web and the endless additional material web in the manner of layers is preferred. It is advantageous if the endless material web is guided in the splicer device in such a way that it can be joined to the endless additional material web in a substantially congruent manner; as a result, a subsequent edge trimming of the material webs can be minimized or omitted entirely.

The at least one deflection roller can be tilted to an oblique position in particular from a neutral position. Tilting the at least one deflection roller relative to the endless material web changes the running direction of said endless material web in its cross direction/extension.

It is expedient if the at least one deflection roller is mounted for rotation.

Advantageously, the storage carriage comprises at least two, more preferably two or three, deflection rollers to allow the endless material web to be deflected a multiple number of times. The deflection rollers are arranged in pairs and are preferably always parallel to each other. In other words, the deflection rollers are preferably tiltable together.

It is advantageous if the non-endless first material web is a non-endless first paper web. Preferably, the non-endless second material web is a non-endless second paper web. The non-endless first material web has an end in the longitudinal direction, in other words it is finite. The non-endless second material web also has an end in the longitudinal direction, in other words it is finite as well.

Advantageously, the joining device has first and second preparation units, first and second joining units, a table unit and a guide. Advantageously, the table unit is displaceable in the guide between the preparation units. Advantageously, the preparation units are displaceable as well, it is advantageous if the joining unit joins, in other words glues, the web end of the non-endless first material web to the web beginning of the non-endless second material web or vice versa. In other words, when the non-endless second material web is running out, it is advantageous if the joining unit joins, in other words glues, the non-endless first material web to the endless material web, or—when the non-endless first material web is running out—joins, in other words glues, the non-endless second material web to the endless material web. It is expedient if the joining unit is configured as a cutting and joining device.

It is advantageous if the storage carriage is guided in the splicer device along its displacement path.

The information processing unit is preferably configured as a control unit which is advantageously electric or electronic.

Advantageously, the corrugated cardboard production assembly for producing corrugated cardboard webs, comprising at least one splicer device according to the invention, a first sensor assembly that is in signal connection with the information processing unit to detect the position of the endless material web, and a second sensor assembly that is in signal connection with the information processing unit to detect the position of another endless material web, wherein preferably the first and second sensor assembly are in each case arranged upstream of a corrugated cardboard production assembly to produce a corrugated cardboard web, comprises a corrugating device for providing the endless first material web or the endless additional material web with a corrugation. It is advantageous if the corrugated cardboard production assembly comprises a joining device, preferably a gluing device, to apply glue to the corrugated endless material web. Preferably, a pressing or compressing device is provided as well to press together the material web provided with glue and the additional material web.

It is advantageous if the first sensor assembly and/or the second sensor assembly is/are contactless. Preferably, the first and/or second sensor assembly is/are configured as an optical sensor arrangement. The first and/or second sensor assembly is/are for instance configured as a light grid.

The first sensor assembly and/or the second sensor assembly preferably detect(s) the transverse position of the respective material web.

It is expedient if the information processing unit evaluates the positional information, in particular regarding the transverse position thereof, detected by the first or second sensor assembly regarding the respective endless material web and compares said information with the positional information, in particular regarding the transverse position, of the other sensor arrangement. The actual position of the one endless material web preferably corresponds to the desired position of the other endless material web. When the information processing unit detects a deviation between the actual position of the one endless material from and the desired position of the other endless material web, the at least one deflection roller is tilted correspondingly to influence the running direction of the material web deflected by said deflection roller to achieve a congruent arrangement of the endless material webs.

The embodiment wherein during tilting, at least an end region of the at least one deflection roller moves substantially along a section of the displacement path of the storage carriage allows the at least one deflection roller to be tilted in an extremely fail-safe and controlled manner. For instance, when the at least one deflection roller is tilted, substantially precisely one end region of said deflection roller moves along the displacement path of the storage carriage. Alternatively, when the at least one deflection roller is tilted, substantially the two opposite end regions of the at least one deflection roller move along the displacement path of the storage carriage. It is advantageous if the two end regions then move in opposite directions substantially along the displacement path of the storage carriage.

In its first tilt end position and/or second tilt end position, the at least one deflection roller is, starting from its neutral position, pivotable to a maximum degree of between 0.5% and 5%. When in its neutral position, it is advantageous if the at least one deflection roller is perpendicular to the transport direction of the endless material web or to a side wall of the splicer device. Advantageously, the at least one deflection roller is tiltable in a horizontal plane. Advantageously, when in its tilted position, the at least one deflection roller runs at an angle relative to the transport direction of the endless material web or to a side wall of the splicer device.

The embodiment in which the storage carriage is substantially entirely tiltable in order to tilt the at least one deflection roller allows the at least one deflection roller to be tilted in an extremely fail-safe and effective manner while resulting in a particularly simply configured splicer device. Advantageously, the storage carriage is tiltable in a horizontal plane.

In an advantageous embodiment, the storage carriage is displaceable between the first end position and the second end position by actuating a displacement device. It is advantageous if the storage carriage is also tiltable by actuating the displacement device.

Advantageously, the displacement device has at least one actuable displacement drive for displacing the storage carriage. It is advantageous if the at least one displacement drive is connected to the storage carriage via at least one transmission element for displacing said storage carriage. The at least one transmission element is preferably endless and drivable in its circumferential direction, in other words in its direction of circulation. It is for instance configured as a transmission chain, transmission rope, transmission belt or the like.

It is advantageous if the at least one displacement drive is in signal connection with the information processing unit. The signal connection can be wireless or wired.

The embodiment in which the storage carriage has two opposite side regions, wherein the displacement assembly is in an actuating connection with the two side regions of the storage carriage to tilt said storage carriage along the displacement path allows the storage carriage to be tilted in an extremely defined manner. Due to leverage, the displacement forces required for this purpose are comparatively low.

The embodiment in which the displacement assembly comprises a first displacement drive which is in direct or indirect actuating connection with the first side region of the storage carriage to displace said storage carriage along the displacement path, and a second displacement drive which is in direct or indirect actuating connection with the second side region of the storage carriage to displace said storage carriage along the displacement path, wherein the two displacement drives are actuable independently of each other to tilt the at least one deflection roller, allows the storage carriage to be tilted in an extremely precise manner. In order to tilt the storage carriage, the displacement drives are actuated differently. The displacement drives can be actuated to different extents or oppositely to each other.

The embodiment in which the displacement assembly comprises precisely one displacement drive that is in direct or indirect actuating connection with a rotatably drivable coupling part to displace the storage carriage results in an extremely cost-effective splicer device. The coupling part is preferably configured as a coupling shaft. The coupling shaft is preferably straight.

In a preferred embodiment, the coupling part is tiltable, wherein spaced-apart coupling part portions thereof are in actuating connection with the side regions of the storage carriage to tilt the at least one deflection roller, so when the coupling part is tilted, this causes the storage carriage to tilt as well, which in turn influences the running direction of the endless material web.

The tilt drive of the displacement assembly for tilting the coupling part is preferably electric, pneumatic or hydraulic. The tilt drive preferably engages the floating bearing side of the storage carriage. Preferably, the tilt drive is configured as a tilt positioning cylinder piston unit. Advantageously, the tilt drive is in signal connection with the information processing unit. The signal connection can be wireless or wired.

The at least one pendulum bearing for tiltably mounting the coupling part is preferably configured as a pendulum ball bearing and has at least two rows of balls. It is expedient if an inner ring, a cage, and the balls of the pendulum ball bearing arranged in the rows of balls are pivotable or deflectable from their neutral position. This allows a tilt of the coupling part to be compensated for. Preferably, the coupling part is mounted in two pendulum bearings.

Two preferred embodiments of the invention will hereinafter be described by way of example with reference to the enclosed drawing.

DESCRIPTION OF THE PREFERRED EMBODIMENTS

Figure 1:
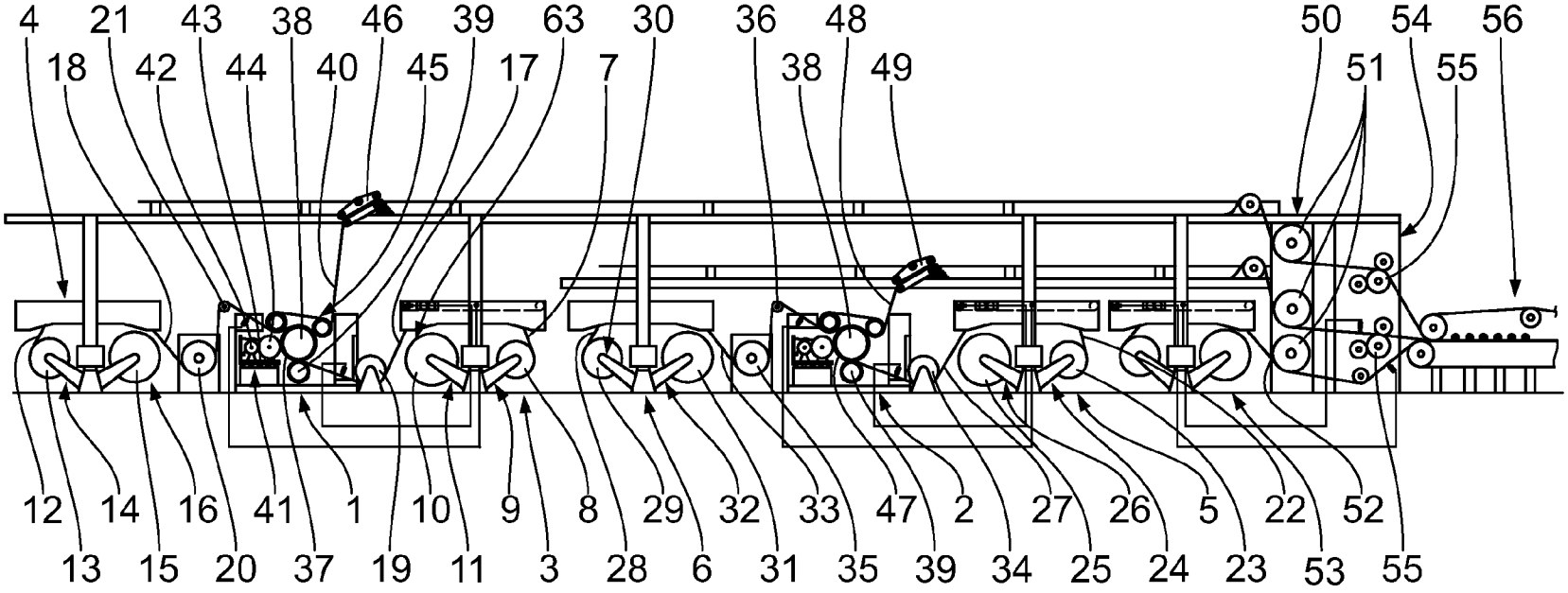
FIG. 1 shows a part of a corrugated cardboard installation according to the invention, the installation comprising a plurality of splicer devices according to a first embodiment.
Figure 2:
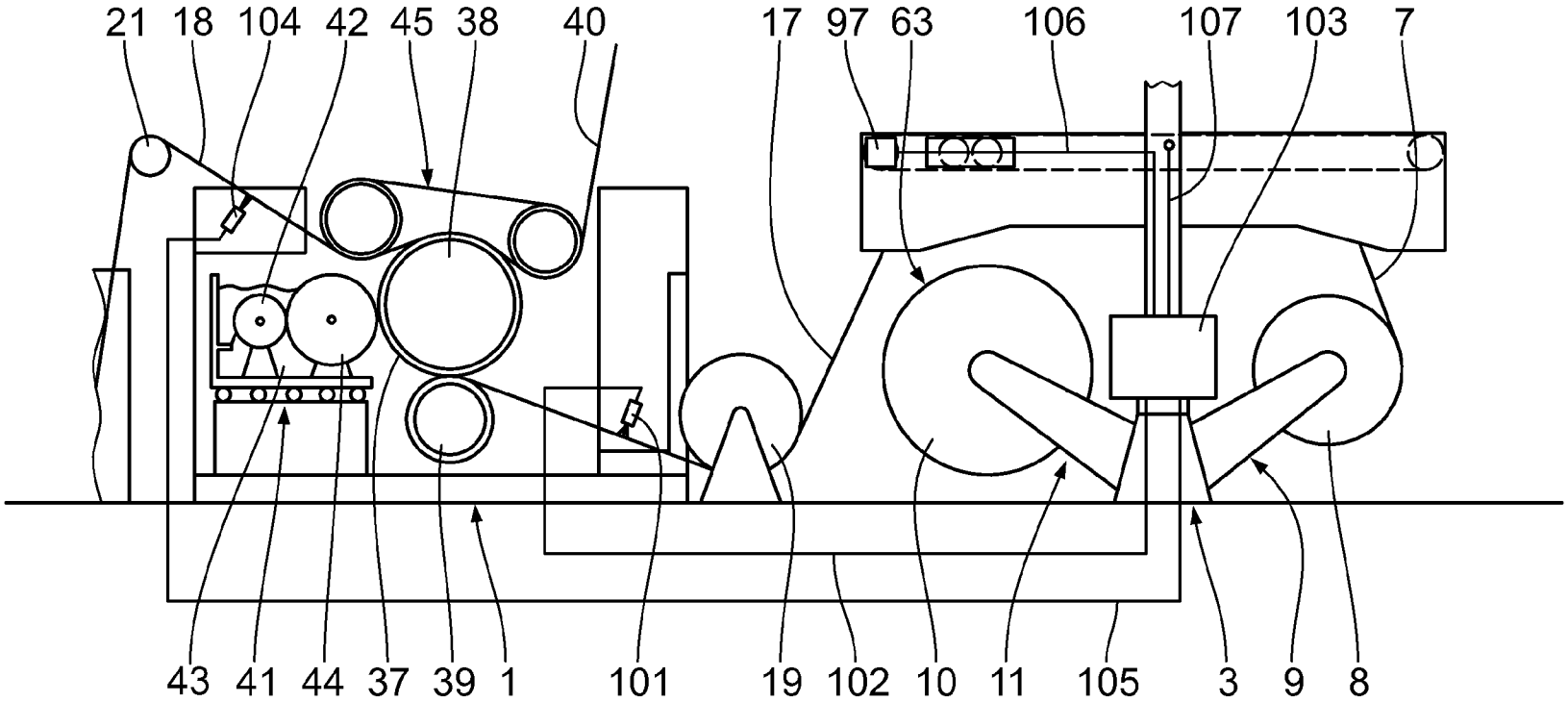
FIG. 2 shows an enlarged view of FIG. 1, said view showing a splicer device according to the invention and a corrugated cardboard production assembly arranged adjacent thereto.
Figure 3:
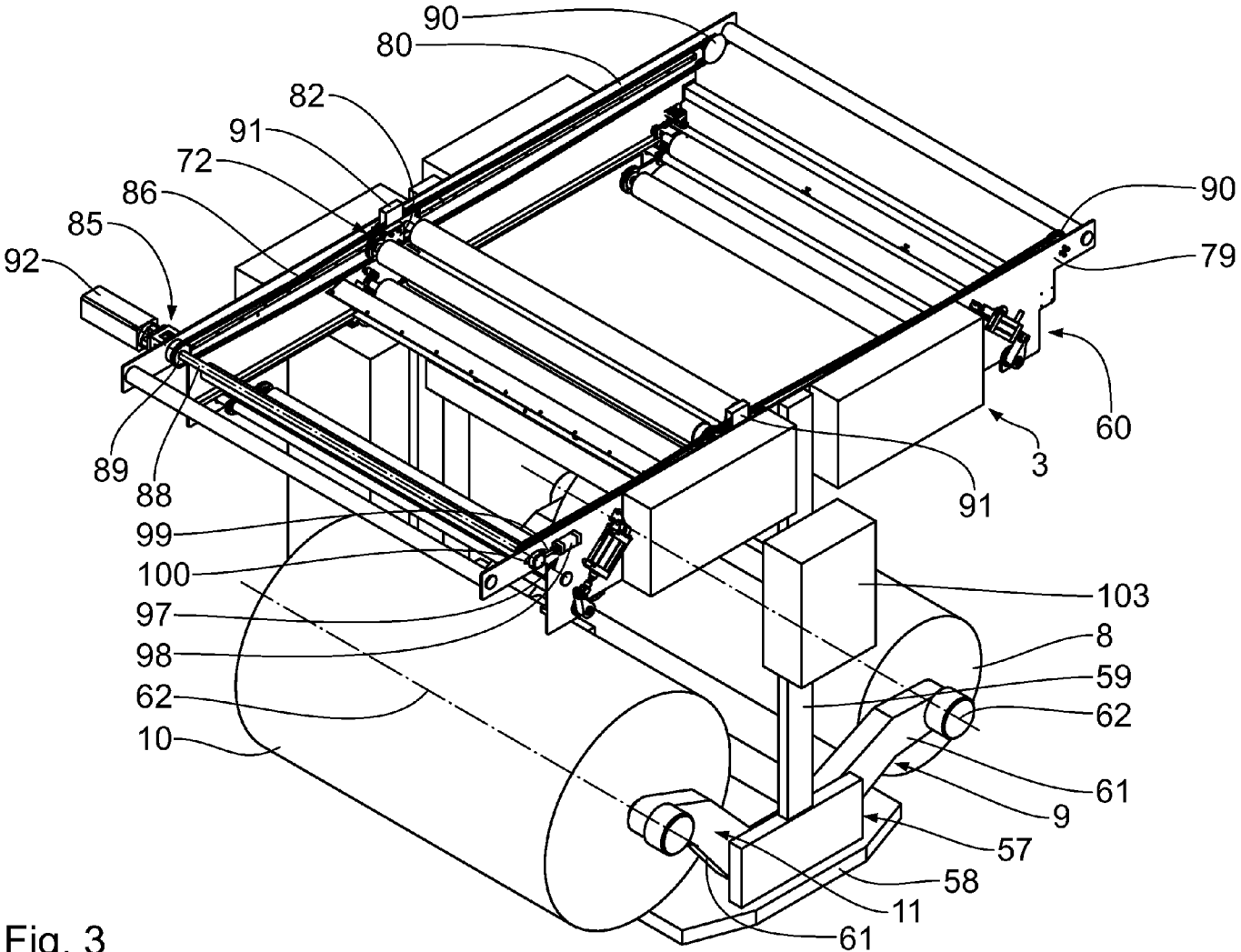
FIG. 3 shows a perspective view of the splicer device shown in FIGS. 1 and 2.

A corrugated cardboard installation as partly shown in FIG. 1 comprises a first corrugated cardboard production assembly 1 for producing an endless corrugated cardboard web laminated on one side, and a second corrugated cardboard production assembly 2 for producing another endless corrugated cardboard web laminated on one side.

The first corrugated cardboard production assembly 1 is associated to a first splicer device 3 and a second splicer device 4 while the second corrugated cardboard production assembly 2 is associated to a third splicer device 5 and a fourth splicer device 6.

In order to unwind a non-endless first material web 7 from a first material web roll 8, the first splicer device 3 comprises a first unwinding unit 9 and a second unwinding unit 11 in order to unwind a non-endless second material web 63 from a second material web roll 10. The non-endless first material web 7 and the non-endless second material web 63 are joined together by means of the first splicer device 3 in order to provide an endless first material web 17.

The second splicer device 4 substantially corresponds to the first splicer device 3. Said second splicer device 4 has a third unwinding unit 14 in order to unwind a non-endless third material web 12 from a third material web roll 13, and a fourth unwinding unit 16 in order to unwind a non-endless fourth material web from a fourth material web roll 15. The non-endless third material web 12 and the non-endless fourth material web are joined together by means of the second splicer device 4 in order to produce an endless second material web 18.

The endless first material web 17 is fed to the first corrugated cardboard production assembly 1 via a first deflection roller 19 while the endless second material web 18 is fed to the first corrugated cardboard production assembly 1 via second deflection rollers 20, 21. The deflection rollers 19 and 20 are configured as preheating devices.

The third splicer device 5 corresponds to the first splicer device 3. Said third splicer device 5 has a fifth unwinding unit 24 in order to unwind a non-endless fifth material web 22 from a fifth material web roll 23, and a sixth unwinding unit 26 in order to unwind a non-endless sixth material web from a sixth material web roll 25. The non-endless fifth material web 22 and the non-endless sixth material web are joined together by means of the third splicer device 5 in order to provide an endless third material web 27.

The fourth splicer device 6 corresponds to the second splicer device 4. Said fourth splicer device 6 has a seventh unwinding unit 30 in order to unwind a non-endless seventh material web 28 from a seventh material web roll 29, and an eighth unwinding unit 32 in order to unwind a non-endless eighth material web from an eighth material web roll 31. The non-endless seventh material web 28 and the non-endless eighth material web are joined together by means of the fourth splicer device 6 in order to provide an endless fourth material web 33.

The endless third material web 27 is fed to the second corrugated cardboard production assembly 2 via a third deflection roller 34 while the endless fourth material web 33 is fed to the second corrugated cardboard production assembly 2 via fourth deflection rollers 35, 36. The deflection rollers 34 and 35 are configured as preheating devices.

The splicer devices 3, 4, 5 and 6 will be explained in more detail below.

In order to produce, from the endless first material web 17, an endless corrugated web 37 that is provided with a corrugation, the first corrugated cardboard production assembly 1 comprises a first corrugating roller 38 mounted for rotation, and a second corrugating roller 39 mounted for rotation. The corrugating rollers 38, 39 together form a roller gap allowing the endless first material web 17 to be passed through in order to be provided with a corrugation, with the axes of rotation of the corrugating rollers 38, 39 being parallel to each other. The corrugating rollers 38, 39 form a corrugating assembly.

In order to join the endless first corrugated web 37 to the endless second material web 18 to form the first corrugated cardboard web 40 laminated on one side, the first corrugated cardboard production assembly 1 has a first glue application assembly 41 which comprises a first glue metering roller 42, a first glue container 43, and a first glue application roller 44. The first glue application roller 44 and the first corrugating roller 38 together form a gap allowing the endless first corrugated web 37 to be passed through in order to be coated with glue, with the first glue application roller 44 being partly arranged in the first glue container 43. The glue is applied to tips of the corrugation of the first corrugated web 37. The first glue metering roller 42 abuts against the first glue application roller 44 and is adapted to form an even layer of glue on the first glue application roller 44. In order to press the endless second material web 18 against the first corrugated web 37 provided with glue, which in turn partly abuts against the first corrugating roller 38, the first corrugated cardboard production assembly 1 has a first pressure module 45. The first pressure module 45 is arranged above the first corrugating roller 38.

For intermediate storage and buffering, the first corrugated cardboard web 40 laminated on one side is fed to a first storage device 46 where it is stored in loops.

The second corrugated cardboard production assembly 2 is identical to the first corrugated cardboard production assembly 1. Details thereof can be found in the description of the preceding embodiment. The endless third material web 27 is provided with a corrugation by means of the corrugating rollers 38, 39 of the second corrugated cardboard production assembly 2 such that a second corrugated web 47 is obtained. The second corrugated web 47 is joined to the endless fourth material web 33 to produce a second corrugated cardboard web 48 laminated on one side.

The second corrugated cardboard web 48 is stored and buffered in a second storage device 49.

Downstream of overhead transport devices and the storage devices 46, 49 provided to subsequently perform the bridge transport of the respective corrugated cardboard web 40 or 48, a preheating assembly 50 is arranged which comprises three heating rollers 51 arranged one above the other. The first corrugated cardboard web 40 and the second corrugated cardboard web 48 as well as a cover layer 52 provided by a fifth splicer device 53 are fed to the preheating assembly 50 where they partly surround the respective heating roller 51. The fifth splicer device 53 corresponds to the first splicer device 3.

Downstream of the preheating assembly 50, a glue application assembly 54 is disposed, the glue application assembly 54 comprising two glue application rollers 55 arranged one above the other, the glue application rollers 55 being partly immersed in a glue bath (not shown). The corrugated cardboard webs 40, 48 laminated on one side are in contact with the respective glue application roller 55.

Downstream of the glue application assembly 54, a heating and pressing device 56 is arranged. In the heating and pressing device 56, the corrugated cardboard webs 40, 48 laminated on one side and the cover layer 52 are pressed and glued together.

A sheet cutting device (not shown) for cutting the five-layer corrugated cardboard web into sheets and a sheet stacking arrangement (not shown) for arranging the sheets in a stack may for instance be arranged downstream of the heating and pressing device 56.

In the following sections, the first splicer device 3 will be described in more detail by way of example. As already mentioned, the other splicer devices 4, 5, 6 and 53 are identical or substantially identical so the following specifications concerning the first splicer device 3 shall apply accordingly.

The first splicer device 3 has a base frame 57 comprising a base frame foot 58, a base frame stand 59 and a base frame carrier 60. The base frame foot 58 is secured to the floor. The base frame stand 59 is secured to the base frame foot 58. The base frame stand 59 extends substantially vertically or perpendicular to the floor. The base frame carrier 60 is secured to an end of the base frame stand 59 opposite to the base frame foot 58 and extends substantially parallel to the floor.

The first unwinding device 9 and the second unwinding device 11 extend from the base frame foot 58. The unwinding devices 9, 11 are pivotably mounted to the base frame foot 58 and are arranged opposite to each other relative to the base frame stand 59.

In order to receive the first material roll 8, the first unwinding device 9 has a receiving cone (not shown) which is inserted in a central opening of the first material roll 8 and is mounted for rotation about a first axis of rotation 62 between two parallel retaining arms 61 of the first unwinding device 9.

The second unwinding device 11 corresponds to the first unwinding device 9. The axes of rotation 62 of the unwinding devices 9, 11 are parallel to each other.

The non-endless first material web 7 is fed to a cutting and joining device 65 via a first feed roller 64 while the non-endless second material web 63 is fed from the material roll 10 to the cutting and joining device 65 via a second feed roller 64. The feed rollers 64 are mounted for rotation to roller carrier arms 6 which are pivotably mounted to the base frame carrier 60 above the material rolls 8 and 10 for tensioning the non-endless material webs 7, 63.

The cutting and joining device 65 is used to produce the endless first material web 17 from the non-endless material webs 7, 63. The cutting and joining device 65 has a first preparation unit 108, a second preparation unit 109, a first joining unit 110, a second joining unit 111, a table unit 112 and a guide 113.

Figure 4:
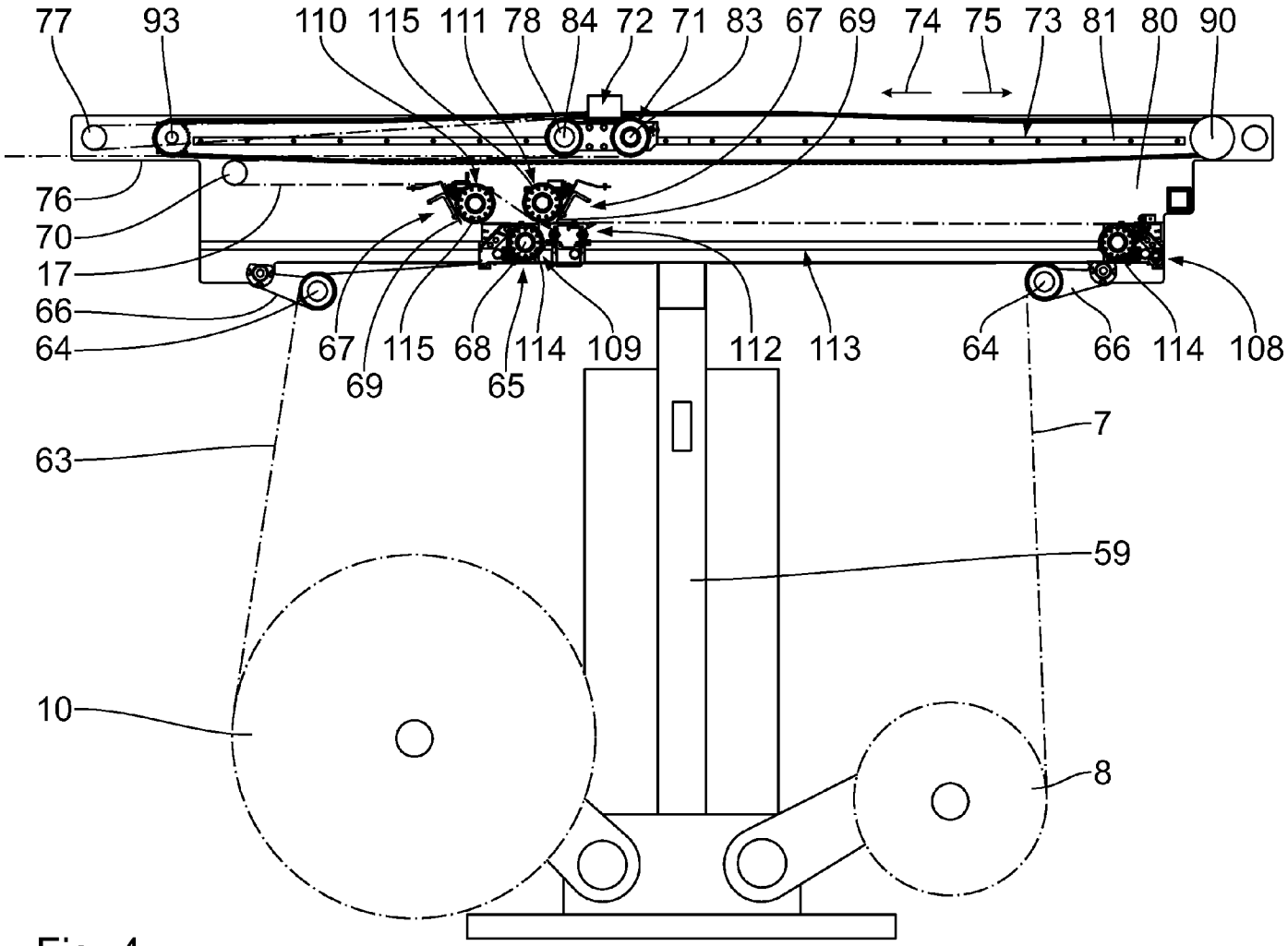
FIG. 4 shows a sectional view of the splicer device shown in FIG. 3.
Figure 5:
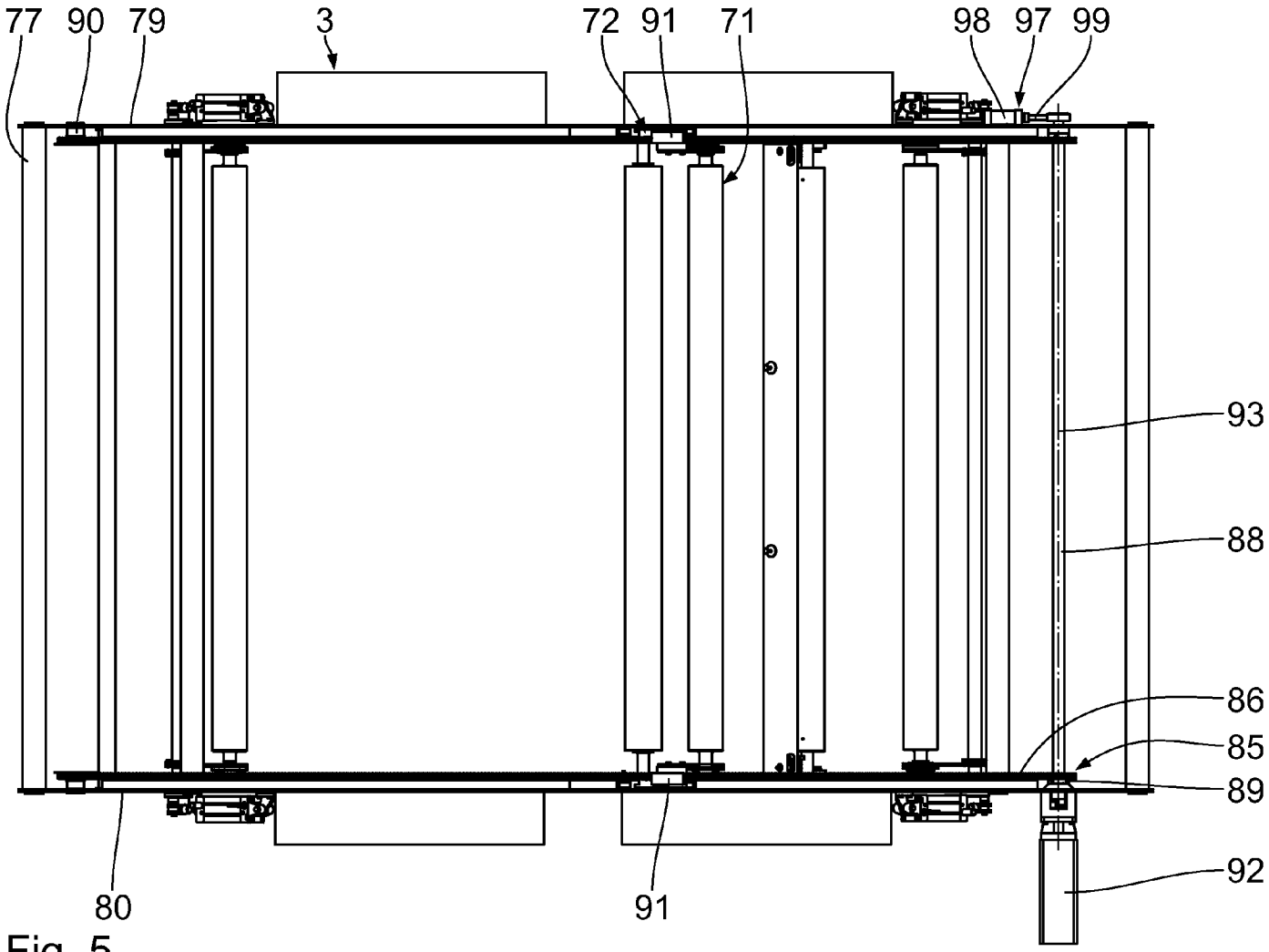
FIG. 5 shows a plan view of the splicer device shown in FIGS. 3 and 4, the storage carriage being in its neutral position.
Figure 6:
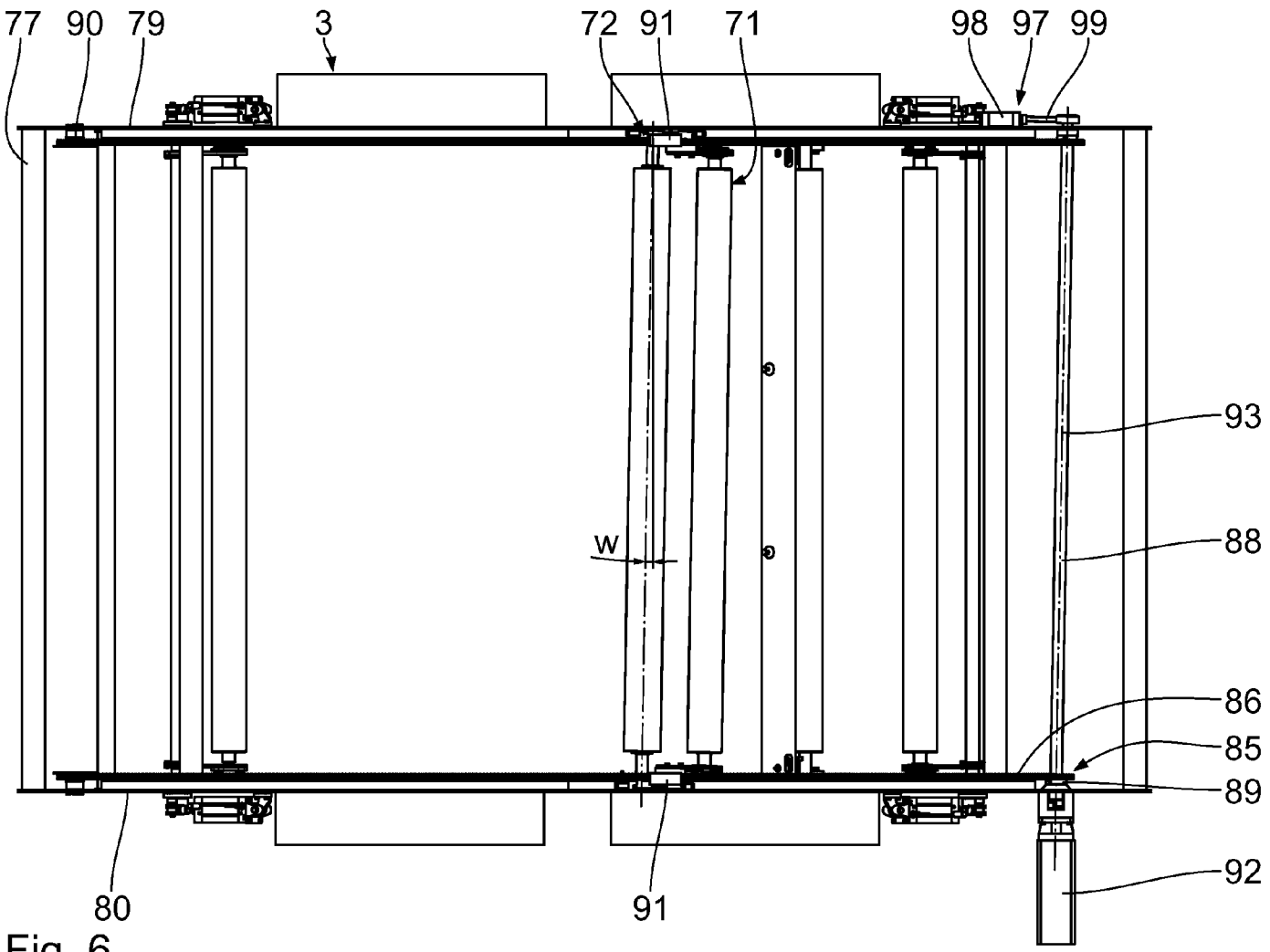
FIG. 6 shows a plan view of the splicer device according to FIG. 5, the storage carriage being in a tilted end position.
Figure 7:
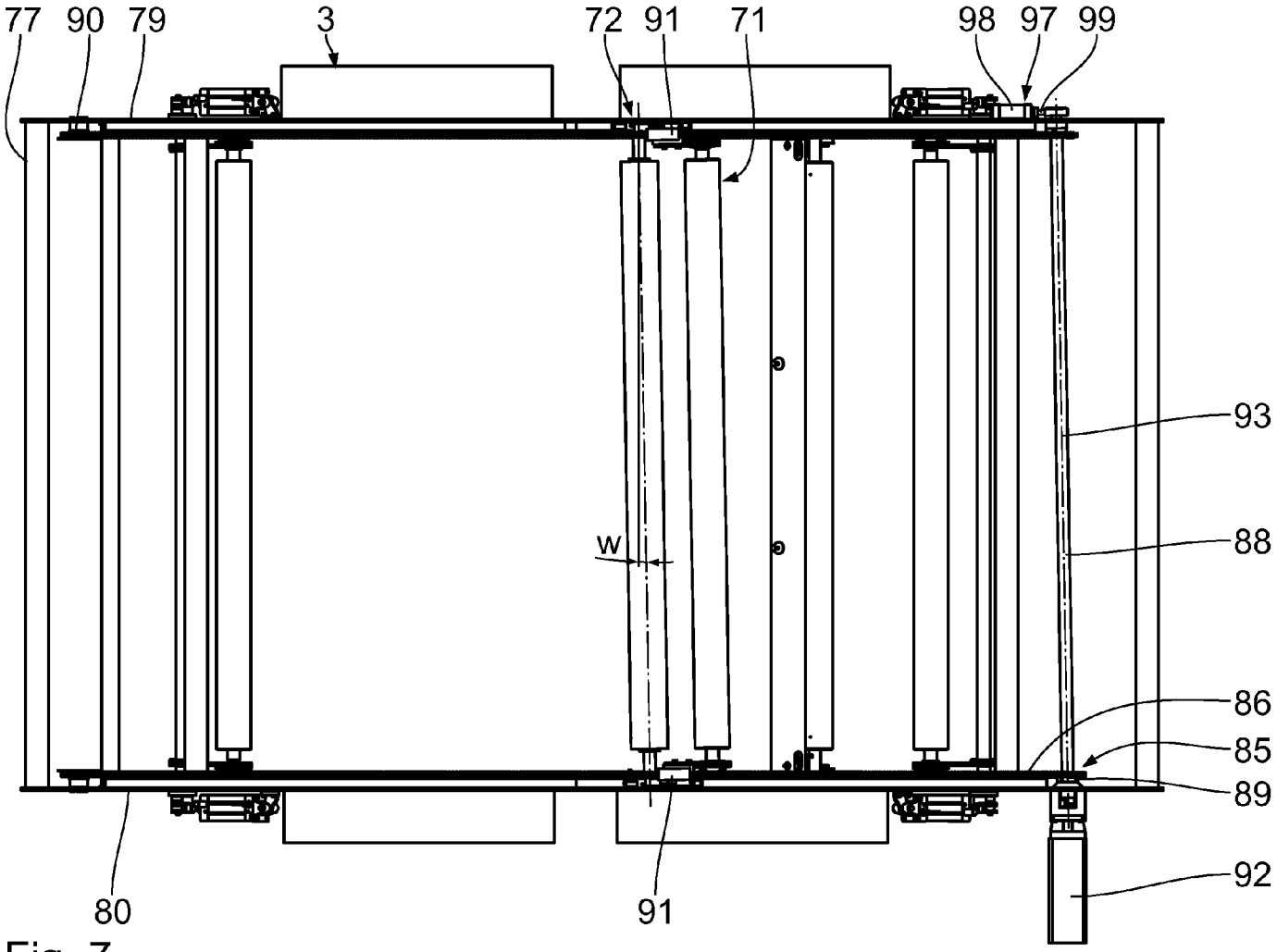
FIG. 7 shows a plan view corresponding to FIG. 6, the storage carriage being in the other tilted end position.
Figure 8:
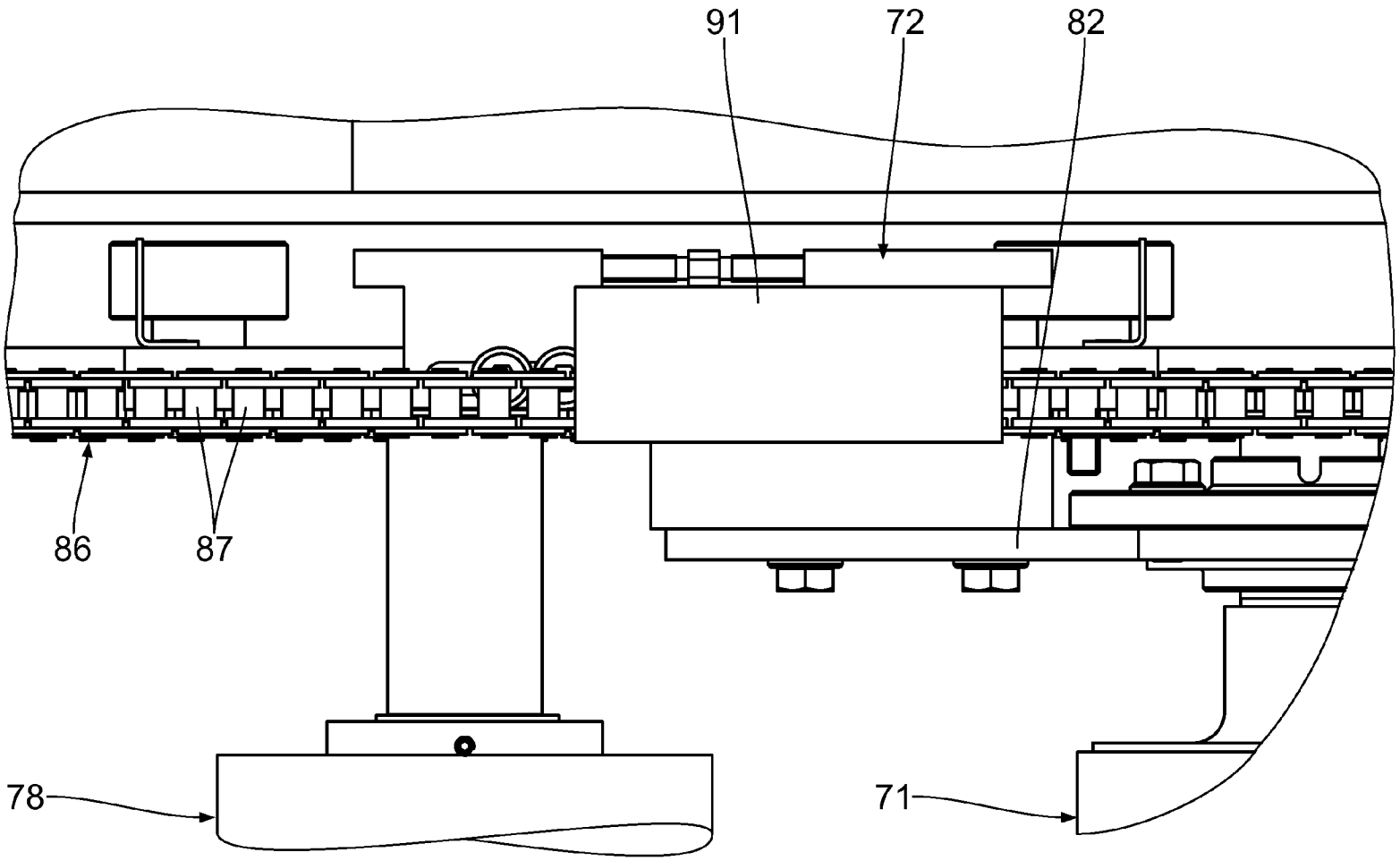
FIG. 8 shows a detailed view of the mounting of the storage carriage being in the neutral position.
Figure 9:
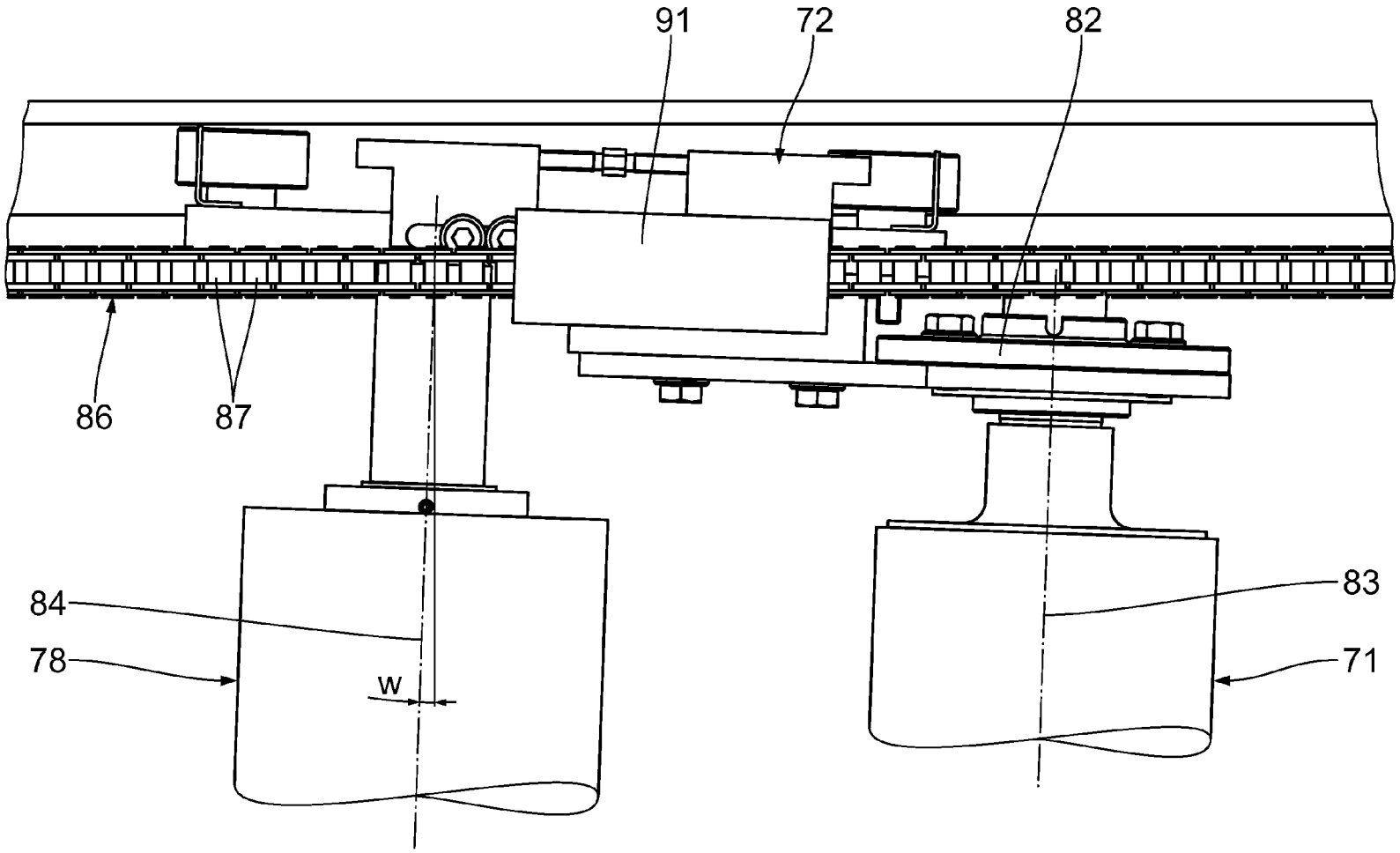
FIGS. 9, 10 show detailed views of the mounting of the storage carriage being in the tilted end positions.
Figure 10:
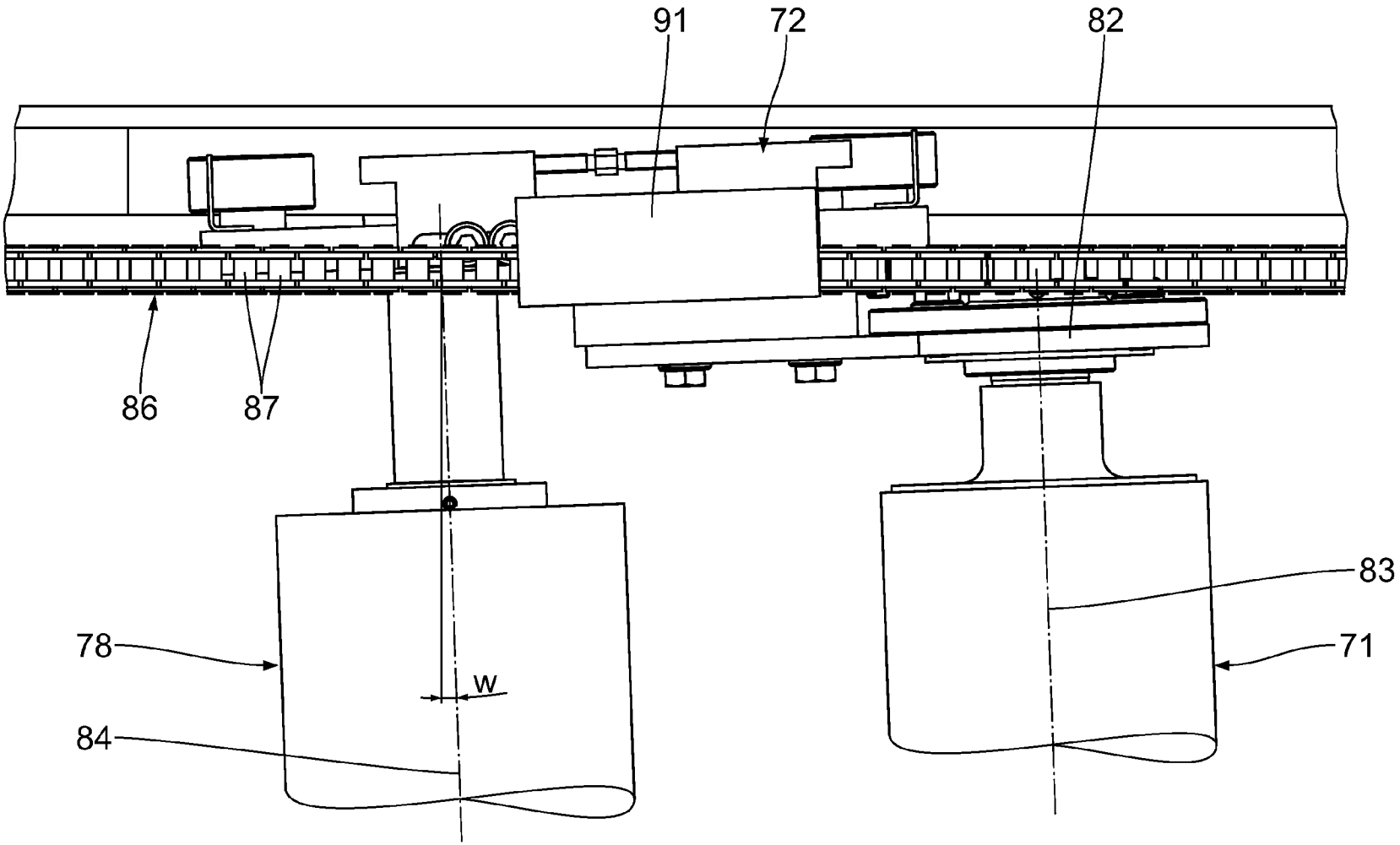
Figure 13:
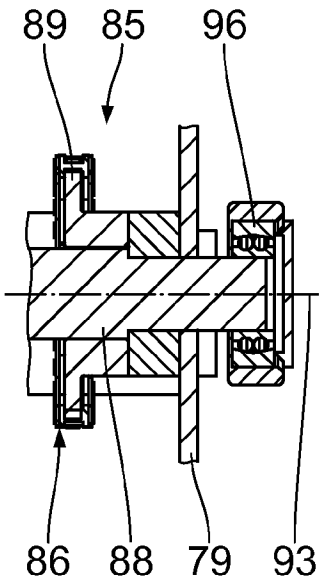
FIGS. 12, 13 show sectional views of a pendulum bearing for mounting the storage carriage of the splicer device shown in FIGS. 4 to 11.
Figure 12:
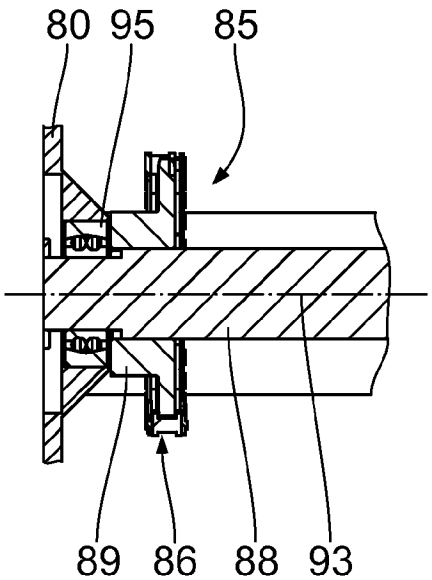
Figure 11:
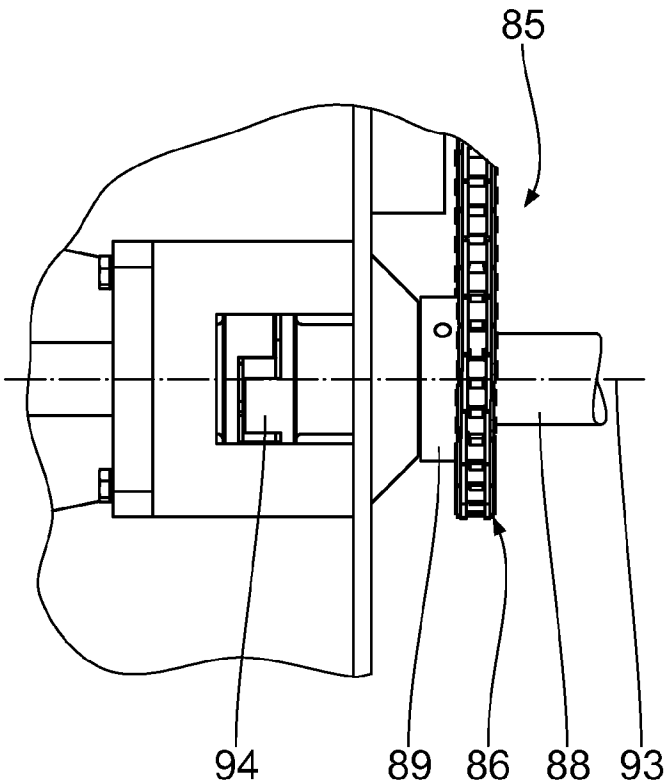
FIG. 11 shows a view of a displacement drive, comprising a coupling, of the splicer device shown in FIGS. 3 to 10.

According to FIG. 4, the first preparation unit 108 is arranged on the base frame carrier 60 substantially above the first material roll 8 while the second preparation unit 109 is arranged on top of the base frame carrier 60 in the region of the second material roll 10. Between the preparation units 108, 109, the guide 113 runs substantially parallel to the floor, wherein the preparation units 108, 109 are displaceable in the guide 113 and the table unit 112 is displaceable between them as well.

The joining units 110, 111 are spaced from each other along the guide 113. They are arranged on the base frame carrier 60 above the guide 113.

The preparation units 108, 109 are configured identically and symmetrically displaceable in the guide 113 relative to a vertical symmetry plane. Due to the identical design of the preparation units 108, 109, only one preparation unit 108, 109 will be explained below.

The second preparation unit 109 has an adhesive roller 114 mounted for rotation in the guide 113 for feeding the non-endless second material web 63 and a cross-cutting device (not shown) comprising an actuable cutting knife for cutting the non-endless second material web 63 thus fed.

For feeding the non-endless second material web 63, the adhesive roller 114 of the second preparation unit 109 is provided with an adhesive layer and displaceable along the guide 113 for transporting the non-endless second material web 63 from the associated cross-cutting device of the second preparation unit 109 to the second joining unit 111.

The joining units 110, 111 are configured identically and arranged symmetrically on the base frame carrier 60 relative to a vertical symmetry plane. Due to the identical design, only one joining unit 110, 110 will be described below.

The second joining unit 111 comprises a cross-cutting device 67 with an actuable cutting knife 69 allowing the non-endless first material web 7 to be cut before it is joined to the non-endless second material web 63, and a pressure roller 115 for joining the non-endless material webs 7, 63 together to form the endless first material web 17. The cross-cutting device 67 of the second joining unit 11 and the pressure roller 115 thereof are mounted to the base frame carrier 60 directly adjacent to the guide 113 such that the adhesive rollers 114 of the preparation units 108, 109 and the table unit 112 are able to pass by the second joining unit 111 in the guide 113. In the position of the adhesive roller 114 of the second preparation unit 109 shown in FIG. 4, the pressure roller 115 of the second joining unit 111 forms a joining gap with said adhesive roller 114 allowing the non-endless material webs 7, 63 to be joined together as well as an adhesive tape to be passed through, the adhesive tape being attachable thereto by means of the second preparation unit 109.

The table unit 112 interacts with the preparation units 108, 109 and/or the joining units 110, 111, and is displaceable along the guide 113 independently thereof. In FIG. 4, the cutting and joining device 65 is in an inactive state. In this state, only the non-endless first material web 7 is moved through the cutting and joining device 65 while the non-endless second material web 63 is in a standby position in the cutting and joining device 65, thus allowing said non-endless second material web 63 to be joined to the non-endless first material web 7 to form the endless first material web 17 as soon as required.

Downstream of the cutting and joining device 65, a first deflection roller 70 is arranged which is mounted for rotation to top of the base frame carrier 60 in the region of the second material roll 10. The endless first material web 17 is guided around the first deflection roller 70.

Downstream of the first deflection roller 70, a second deflection roller 71 is arranged which is mounted for rotation to a storage carriage 72. The storage carriage 72 is arranged in the region of an upper end of the base frame carrier 60 opposite to the base frame stand 59 and is displaceable in a storage carriage guide 73, which extends parallel to the floor and defines a displacement path for the storage carriage 72. The storage carriage guide 73 extends substantially along the entire base frame carrier 60. The storage carriage 72 is displaceable between a first end position and a second end position. It is displaceable in opposite displacement directions 74, 75. In the first end position, the storage carriage 72 is adjacent to an outlet 76 of the endless first material web 17 while in the second end position, the storage carriage 72 is spaced, in other words remote from the outlet 76. In FIG. 4, the storage carriage 72 is shown in an intermediate position between the two end positions.

In order to deflect the endless first material web 17 in the region of the outlet 76, a third deflection roller 77 is mounted for rotation to the base frame carrier 60.

Downstream of the third deflection roller 77, a fourth deflection roller 78 is arranged which is mounted for rotation to the storage carriage 72 between the second deflection roller 71 and the third deflection roller 77. The second and fourth deflection rollers 71, 78 are always parallel to each other.

The base frame carrier 60 has two opposite and parallel side walls 79, 80. The side walls 79, 80 are spaced from each other.

The first deflection roller 70 and the third deflection roller 77 extend in each case between the side walls 79, 80 and are preferably mounted for rotation in or on these side walls 79, 80. They are substantially perpendicular to the side walls 79, 80.

The storage carriage 72 is arranged between the side walls 79, 80. Each side wall 79, 80 carries a guide part 81 for guiding the storage carriage 72. The guide parts 81 are opposite and parallel to each other. Together, they form the storage carriage guide 73. The storage carriage guide 73 runs above and parallel to the guide 113.

The storage carriage 72 has two opposite side parts 82 which are configured identically, strictly speaking mirror symmetrically. The storage carriage 72 forms a rigid unit. The second deflection roller 71 and the fourth deflection roller 78 are mounted in the side parts 82 for rotation about their central longitudinal axes 83 and 84, respectively.

In order to displace the storage carriage 72 along the storage carriage guide 73, the first splicer device 3 has a displacement assembly 85. The displacement assembly 85 comprises two transmission chains 86 which are configured identically and run separately from each other. Each transmission chain 86 is endless and comprises a plurality of chain links 87. One transmission chain 86 is arranged on the inside such as to run adjacent to the side wall 79 while the other transmission chain 86 is arranged on the inside such as to run adjacent to the other side wall 80.

A coupling rod 88 of the displacement assembly 85 extends between the side walls 79, 80 adjacent to the third deflection roller 77. The coupling rod 88 is mounted in or to the side walls 79, 80 so as to define the displacement path 73 of the storage carriage 72. It is rotatable, strictly speaking drivable for rotation, about its central longitudinal axis 93. The coupling rod 88 and the second deflection roller 71 as well as the fourth deflection roller 78 are preferably always parallel to each other.

Adjacent to the side walls 79, 80, the coupling rod 88 is provided with two sprocket wheels 89 that are adapted to the transmission chains 86 and co-rotate with the coupling rod 88. Each transmission chain 86 is guided around a sprocket wheel 89 such that the transmission chains 86 are in an actuating connection with the coupling rod 88 via the sprocket wheels 89.

Each transmission chain 86 is further guided around a deflection wheel 90 mounted for rotation to the respective side wall 79 or 80, respectively. The deflection wheels 90 delimit the displacement path 73 of the storage carriage 72.

Each side part 82 of the storage carriage 72 is rigidly connected to the transmission chain 86 arranged adjacent thereto by means of a respective driver 91.

The coupling rod 88 is drivable for rotation about its central longitudinal axis 93 by means of a displacement drive 92 of the displacement assembly 85. During operation, a rotation of the coupling rod 88 causes the sprocket wheels 89 to rotate such that the transmission chains 86 are actuated. When the transmission chains 86 are actuated, this causes the storage carriage 72 to be displaced correspondingly along the storage carriage guide 72 by means of the drivers 91.

The displacement drive 92 has a flexible coupling 94 which on the one hand allows the coupling rod 88 to be driven for rotation while allowing an angular offset of the coupling rod 88.

The coupling rod 88 is mounted for rotation in or to the side wall 80 via a pendulum ball bearing 95. It is mounted in or to the other side wall 79 via another pendulum ball hearing 96.

The pendulum ball bearing 96 is engaged by a tilt drive 97 which comprises a casing 98 and a tilt rod 99 guided for displacement in the casing 98. In order to tilt the coupling rod 88, an elongated hole 100 is arranged in the side wall 79 that extends in the displacement direction 74 or 75. The coupling rod 88 is tiltable by retracting or extending the tilt rod 99. When the coupling rod 88 is tilted, this causes the storage carriage 72 to be tilted correspondingly. When the coupling rod 88 is being tilted, it moves along the elongated hole 100.

In the neutral position of the coupling rod 88, the coupling rod 88 is perpendicular to the side walls 79, 80 and substantially perpendicular to the endless first material web 17 and its transport direction. The same applies to the deflection rollers 71, 78.

When the coupling rod 88 is deflected, in other words tilted, it extends at an angle relative to the side walls 79, 80 and the endless first material web 17 and its transport direction. The same applies to the deflection rollers 71, 78 and the storage carriage 72.

In the following sections, the functioning of the first splicer device 3 will be described in more detail. The non-endless first material web 7 is wound off the first material roll 8 and guided to the cutting and joining device 65 via the first feed roller 64 where the non-endless first material web 7 is deflected through approximately 90°. The same applies substantially to the non-endless second material web 63 which is deflected by the second feed roller 64.

Downstream of the cutting and joining device 65, the endless first material web 17 is guided around the first deflection roller 70 where it is deflected through approximately 180°. The endless first material web 17 is then moved to the second deflection roller 71 where it is again deflected through approximately 180°. Downstream of the second deflection roller 71, the endless first material web 17 is guided around the third deflection roller 77 where it is again deflected through approximately 180°. Downstream of the third deflection roller 77, the endless first material web 17 is guided around the fourth deflection roller 78 where it is again deflected through approximately 180° before being moved to the outlet 76. Via the outlet 76, the endless first material web 17 is discharged from the first splicer device 3. Since the non-endless first material web 7 is wound off continuously, the first material roll 8 will run out after a given period of time so the non-endless second material web 63 needs to be joined to the non-endless first material web 7.

To this end, the beginning of the non-endless second material web 63 is manually provided with a single-sided adhesive tape by the operating personnel of the corrugated cardboard installation, preferably across the entire material web width, before it is fed to the second feed roller 64.

The non-endless second material web 63 is then fed, via the second feed roller 64, to the second preparation unit 109 displaced, for this purpose, to a position above the second feed roller 64. As soon as the non-endless second material web 63 is fixed to the adhesive roller 114 of the second preparation unit 109, preferably to the outer jacket thereof, the second preparation unit 109 is displaced in the guide 113 in the direction of the first feed roller 64 to the position shown in FIG. 4.

Subsequently, the unwinding process of the first unwinding device 8, in other words of the non-endless material web 7, is stopped.

By displacing the storage carriage 72 to the first end position, the loops formed by the endless first material web 17 are loosened by the deflection rollers 70, 71, 77, 78, thus allowing the endless first material web 17 to be discharged from the first splicer device 3, in other words conveyed, continuously.

The endless first material web 17 is pressed, by means of the pressure roller 115 of the second joining unit 111, said pressure roller 115 being moved to the adhesive roller 114 of the second preparation unit 109 by means of a pneumatically operated pivoting unit (not shown), against the adhesive end of the single-sided adhesive tape attached to the beginning of the non-endless second material web 63 at the previously determined position on the adhesive roller 114 of the second preparation unit 109. The endless first material web 17 is thus joined to the non-endless second material web 63. The feeding of the non-endless first material web 7 to the endless first material web 17 is stopped.

In order to produce a first cutting edge, the table unit 112 is displaced in the guide 113 such that a cutting blade of the cutting knife 69, displaced by a linear unit (not shown), of the cross-cutting device 67 of the second joining unit 11 is able to fully immerse into a recess, provided in the table unit 112 for the cutting knife 69 of the cross-cutting device 67 of the second joining unit 111, across the entire width thereof in order to separate the non-endless first material web 7 from the endless first material web 17.

Once the cutting process for separating the endless first material web 17 from the non-endless first material web 7 is completed, the cutting knife 69 of the cross-cutting device 67 of the second joining unit 111 and the pressure roller 115 of the second joining unit 11 are moved back to their respective initial positions, causing the endless first material web 17, which is now joined to the non-endless second material web 63, to be released. The second preparation unit 109 is displaced in the guide 113 to a position downstream of the second feed roller 64, said position being mirror symmetric to the position of the first preparation unit 108 shown in FIG. 4, wherein the adhesive roller 114 of said second preparation unit 109 is used to convey the non-endless second material web 63.

Due to the known length of the non-endless second material web 63, the first splicer device 3 is able to recognize when the second material web 10 will be running out. Before this happens, the non-endless first material web 7 thus prepared is joined to the non-endless second material web 63. This is done in the same way as the replacement of the non-endless material webs 7, 63 explained above.

To this end, the beginning of the non-endless first material web 7 is also provided manually with a single-sided adhesive tape by the operating personnel of the corrugated cardboard installation, preferably across its entire material web width, before it is fed to the first feed roller 64.

The non-endless first material web 7 is then moved, via the first feed roller 64, to the first preparation unit 108 displaced to a position above the first feed roller 64 for this purpose. Once the non-endless first material web 7 is fixed to the adhesive roller 114 of the first preparation unit 108, preferably to the outer jacket thereof, the first preparation unit 108 is displaced in the guide 113 in the direction of the second feed roller 64 to a position mirror symmetric to the position of the second preparation unit 109 shown in FIG. 4.

Subsequently, the unwinding process of the second unwinding device 11, in other words of the non-endless second material web 63, is stopped.

By displacing the storage carriage 72 to the first end position, the loops formed by the endless first material web 17 are pulled apart by the deflection rollers 70, 71, 77, 78, thus allowing the endless first material web 17 to be discharged from the first splicer device 3, in other words conveyed, continuously.

The endless first material web 17 is pressed, by means of the pressure roller 115 of the first joining unit 110, said pressure roller 115 being moved towards the adhesive roller 114 of the first preparation unit 108 by means of a pneumatically operated pivoting unit (not shown), against the adhesive end of the single-sided adhesive tape attached to the beginning of the non-endless first material web 7 at the previously determined position on the adhesive roller 114 of the second preparation unit 108. The endless first material web 17 is thus joined to the non-endless first material web 7. The feeding of the non-endless second material web 63 to the endless first material web 17 is stopped.

In order to produce a second cutting edge, the table unit 112 is displaced in the guide 113 such that a cutting blade of the cutting knife 69, displaced by a linear unit (not shown), of the cross-cutting device 67 of the first joining unit 110 is able to immerse into a recess provided in the table unit 112 for the cutting knife 69 of the cross-cutting device 67 of the second joining unit 110 across the entire width thereof in order to separate the non-endless second material web 63 from the endless first material web 17.

Once the cutting process for separating the endless first material web 17 from the non-endless second material web 63 is completed, the cutting knife 69 of the cross-cutting device 67 of the first joining unit 110 and the pressure roller 115 of the first joining unit 110 are moved back to their respective initial positions, causing the endless first material web 17, which is now joined to the non-endless first material web 7, to be released. The first preparation unit 108 is displaced in the guide 113 to a position downstream of the first feed roller 64, said position being identical to the position shown in FIG. 4, wherein the adhesive roller 114 of said first preparation unit 108 is used to convey the non-endless first material web 7.

The first cutting edge and the second cutting edge are complementary to each other so that one can be joined to the other substantially without overlaps. The cuts may be profiled, thus allowing them to be arranged in a finger-like configuration. As a result of the cutting process, second cutting edge protrusions and cutting edge recesses were formed.

Consequently, the endless first material web 17 thus produced shows the joining region defined by the adhesive tape in which the non-endless material webs 7, 63 engage each other in the manner described above along their transport directions.

After joining together the non-endless material webs 7, 63, the non-endless second material web 63 is wound off the second material roll 10. While the non-endless second material web 63 is being wound off, the storage carriage 72 is—in order to form the endless first material web 17 into loops—displaced almost (but not entirely) up to other end position as this storage path is also used to regulate the web tension.

When the endless first material web 17 and the endless second material web 18 are arranged at a lateral offset relative to each other in the first corrugated cardboard production assembly 1, then the coupling rod 88—and therefore the storage carriage 72 as well—are tilted correspondingly to compensate for the offset between the endless first material web 17 and the endless second material web 18. When the storage carriage 72 is tilted, this causes the running direction of the endless first material web 17 to change.

In order to detect a course of the endless first material web 17, a first sensor assembly 101 is provided, which is arranged between the first splicer device 3 and the first corrugated cardboard production device 1, strictly speaking between the first deflection roller 19 and the first corrugated cardboard production device 1. The first sensor assembly 1 is in signal connection with an information processing unit 103 via a first signal line 102.

A second sensor assembly 104 is associated to the endless second material web 18. Said second sensor assembly 104 is disposed between the second splicer device 4 and the first corrugated cardboard production assembly 1, strictly speaking between the second deflection roller 21 and the first corrugated cardboard production assembly 1. The second sensor assembly 4 is in signal connection with the information processing unit 103 via a second signal line 105.

The information processing unit 103 receives, via the signal lines 102, 105, positional information regarding a potential lateral offset of the respective endless material web 17 or 18, respectively.

Via a third signal line 106, the information processing unit 103 is in signal connection with the tilt drive 97.

Via a fourth signal line 107, the information processing unit 103 is in signal connection with the displacement drive 92.

Depending on a lateral offset between the endless first material web 17 and the endless second material web 18 detected by the sensor assemblies 101 or 104, respectively, the tilt drive 97 is actuated, if necessary, by the information processing unit 103 via the third signal line 106 in such a way that the coupling rod 88 is tilted.

Figure 14:
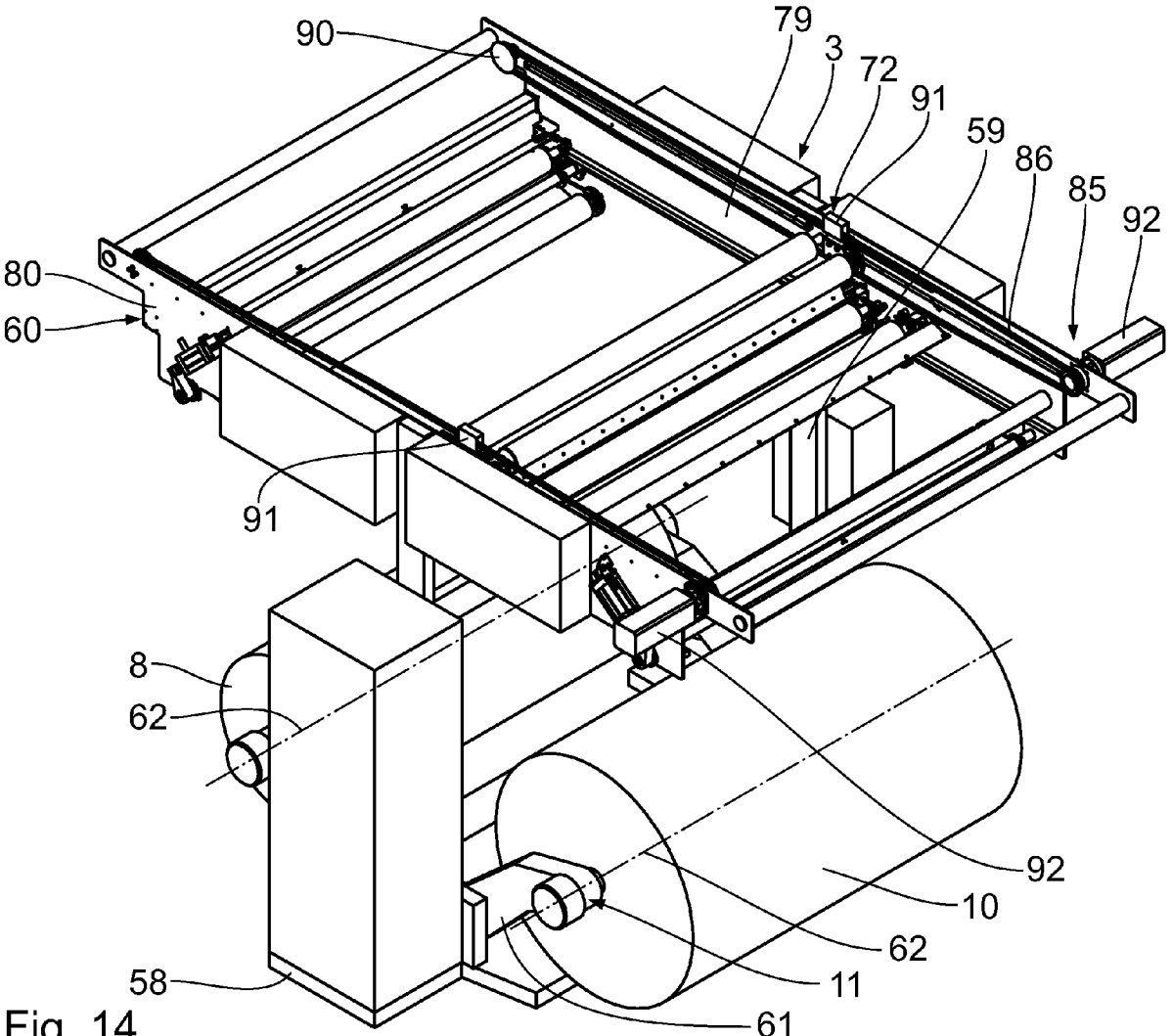
FIG. 14 shows a perspective view of a second embodiment of a splicer device according to the invention.
Figure 15:
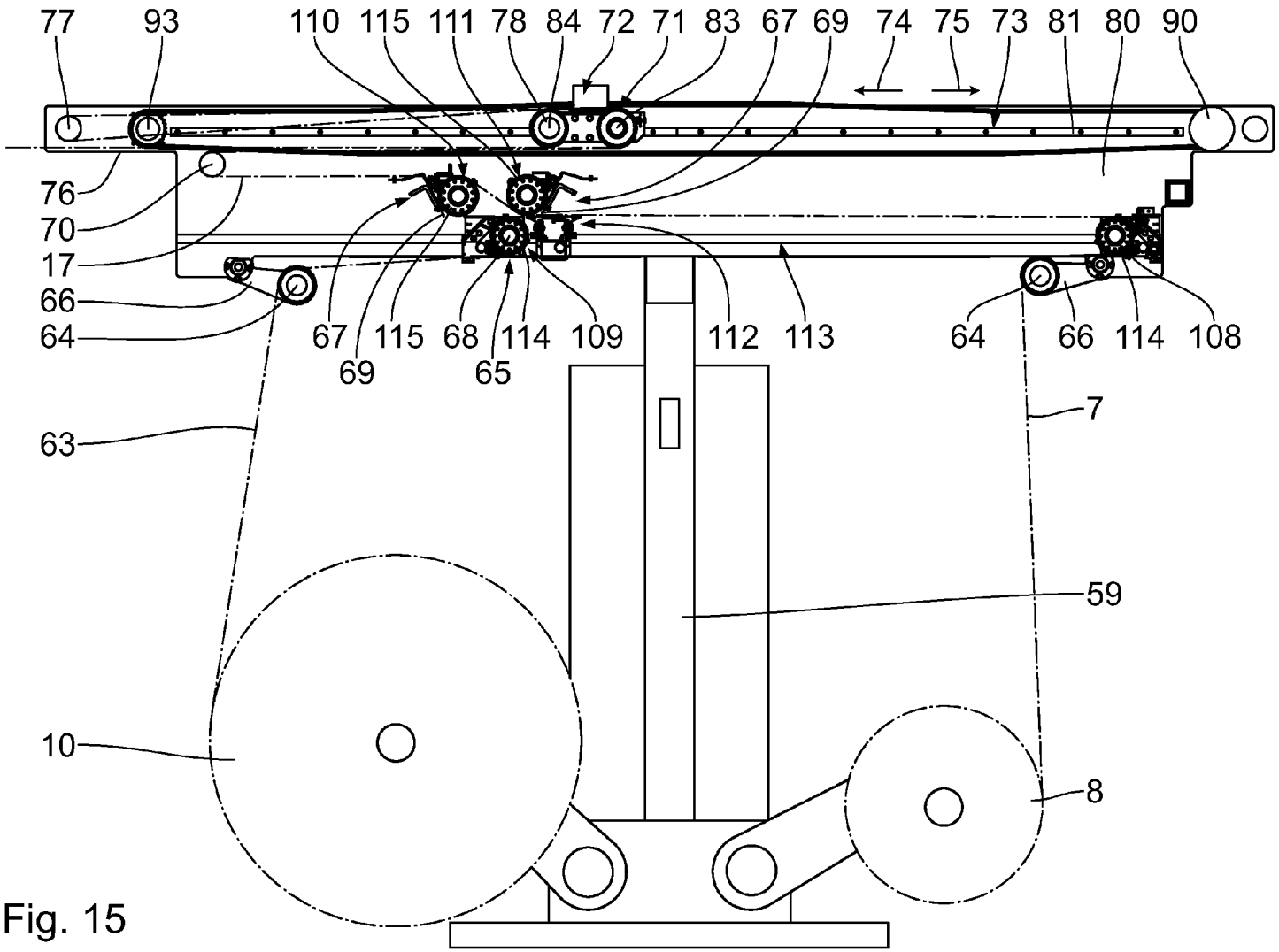
FIG. 15 shows a sectional view of the splicer device shown in FIG. 14.
Figure 16:
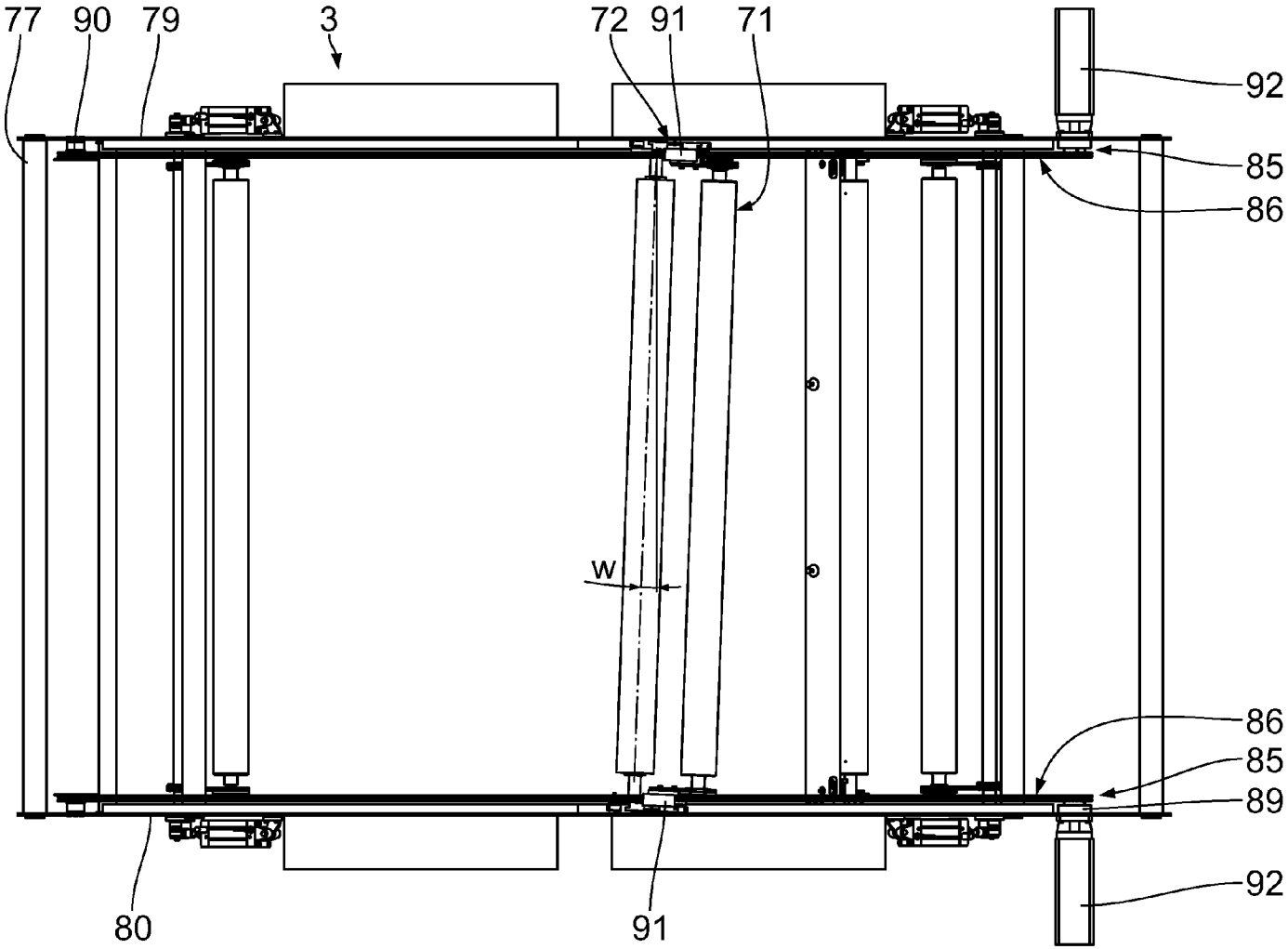
FIG. 16 shows a plan view of the splicer device shown in FIGS. 14 and 15, the storage carriage being in its neutral position.

In the following sections, the second embodiment will be described with reference to FIGS. 14 to 16. In contrast to the previous embodiment to which reference is made herewith, no coupling rod 88 is provided. Instead, a second displacement drive 92 is provided. Each transmission chain 86 is actuable by its own displacement drive 92. The displacement drives 92 are actuable independently of each other such that the transmission chains 86 are actuated independently of each other as well. When the displacement drives 92 are actuated differently by the information processing unit 103, this causes the storage carriage 72 and the deflection rollers 71, 78 to tilt. When it is desired to displace the storage carriage 72 along the storage carriage guide 73, the displacement drives 92 are actuated identically.

The two displacement drives 92 are in signal connection with the information processing unit 103 via respective fourth signal lines.

Alternatively, the splicer devices 3, 4 are adapted for use in a corrugated cardboard installation for producing a three-layer corrugated cardboard web.

Alternatively, the splicer devices 4, 6 are not provided with a tiltable storage carriage 72.

What is claimed is:

1. A splicer device for splicing material webs, comprising a) a first unwinding device to unwind a non-endless first material web from a first material roll, b) a second unwinding device to unwind a non-endless second material web from a second material roll, c) a joining device for joining together the non-endless first material web and the non-endless second material web to form an endless material web, d) a storage carriage which i) comprises at least one deflection roller to deflect the endless material web, and ii) is displaceable along a displacement path between a first end position and a second end position allowing one of the formation and loosening of material web loops of the endless material web, iii) wherein the at least one deflection roller has a respective central longitudinal axis, and is tiltable between a first tilt end position and a second tilt end position by tilting the respective central longitudinal axis to influence a running direction of the endless material web, and e) an information processing unit to cause tilting of the at least one deflection roller depending on positional information regarding at least one of the endless material web and another endless material web to be joined to the endless material web; wherein the storage carriage is substantially tiltable in order to tilt the at least one deflection roller.

2. A splicer device according to claim 1, wherein during tilting, at least an end region of the at least one deflection roller moves substantially along a section of the displacement path of the storage carriage.

3. A splicer device according to claim 1, wherein in at least one of the first tilt end position and second tilt end position of the deflection roller, the at least one deflection roller forms a maximum tilt angle of between 0.5° and 5° relative to a neutral position of the at least one deflection roller.

4. A splicer device according to claim 1, wherein the storage carriage is displaceable between the first end position and the second end position by actuating a displacement assembly.

5. A splicer device according to claim 4, wherein the storage carriage has two opposite side regions, wherein the displacement assembly is in an actuating connection with the two side regions of the storage carriage to tilt said storage carriage along the displacement path.

6. A splicer device according to claim 5, wherein the displacement assembly comprises a) a first displacement drive which is in one of a direct and an indirect actuating connection with the first side region of the storage carriage to displace said storage carriage along the displacement path, and b) a second displacement drive which is in one of a direct and an indirect actuating connection with the second side region of the storage carriage to displace said storage carriage along the displacement path, c) wherein the two displacement drives are actuable independently of each other to tilt the at least one deflection roller.

7. A splicer device according to claim 6, wherein the first displacement drive is in actuating connection with the first side region of the storage carriage via a first transmission element, and the second displacement drive is in actuating connection with the second side region of the storage carriage via a second transmission element.

8. A splicer device according to claim 5, wherein the displacement assembly comprises only one displacement drive which is in one of a direct and an indirect actuating connection with a rotatably drivable coupling part to displace the storage carriage.

9. A splicer device according to claim 8, wherein the coupling part is tiltable, wherein spaced-apart coupling part portions thereof are in actuating connection with the side regions of the storage carriage to tilt the at least one deflection roller.

10. A splicer device according to claim 8, wherein the displacement assembly comprises a tilt drive to tilt the coupling part.

11. A splicer device according to claim 8, wherein the coupling part is tiltably mounted in at least one pendulum bearing.

12. A splicer device for splicing material webs, comprising a) a first unwinding device to unwind a non-endless first material web from a first material roll, b) a second unwinding device to unwind a non-endless second material web from a second material roll, c) a joining device for joining together the non-endless first material web and the non-endless second material web to form an endless material web, d) a storage carriage which i) comprises at least one deflection roller to deflect the endless material web, and ii) is displaceable along a displacement path between a first end position and a second end position allowing one of the formation and loosening of material web loops of the endless material web, iii) wherein the at least one deflection roller—has a respective central longitudinal axis, and—is tiltable between a first tilt end position and a second tilt end position by tilting the respective central longitudinal axis to influence a running direction of the endless material web, and e) an information processing unit to cause tilting of the at least one deflection roller depending on positional information regarding at least one of the endless material web and another endless material web to be joined to the endless material web; wherein the storage carriage is displaceable between the first end position and the second end position by actuating a displacement assembly; wherein the storage carriage has two opposite side regions, wherein the displacement assembly is in an actuating connection with the two side regions of the storage carriage to tilt said storage carriage along the displacement path.

13. A splicer device according to claim 12, wherein during tilting, at least an end region of the at least one deflection roller moves substantially along a section of the displacement path of the storage carriage.

14. A splicer device according to claim 12, wherein in at least one of the first tilt end position and second tilt end position of the deflection roller, the at least one deflection roller forms a maximum tilt angle of between 0.50o and 5o relative to a neutral position of the at least one deflection roller.

15. A splicer device according to claim 12, wherein the storage carriage is substantially tiltable in order to tilt the at least one deflection roller.

16. A splicer device according to claim 12, wherein the displacement assembly comprises a) a first displacement drive which is in one of a direct and an indirect actuating connection with the first side region of the storage carriage to displace said storage carriage along the displacement path, and—b) a second displacement drive which is in one of a direct and an indirect actuating connection with the second side region of the storage carriage to displace said storage carriage along the displacement path, c) wherein the two displacement drives are actuable independently of each other to tilt the at least one deflection roller.

17. A splicer device according to claim 16, wherein the first displacement drive is in actuating connection with the first side region of the storage carriage via a first transmission element, and the second displacement drive is in actuating connection with the second side region of the storage carriage via a second transmission element.

18. A splicer device according to claim 12, wherein the displacement assembly comprises only one displacement drive which is in one of a direct and an indirect actuating connection with a rotatably drivable coupling part to displace the storage carriage.

19. A splicer device according to claim 18, wherein the coupling part is tiltable, wherein spaced-apart coupling part portions thereof are in actuating connection with the side regions of the storage carriage to tilt the at least one deflection roller.

20. A splicer device according to claim 18, wherein the displacement assembly comprises a tilt drive to tilt the coupling part.

21. A splicer device according to claim 18, wherein the coupling part is tiltably mounted in at least one pendulum bearing.

* * * * *